United States Patent [19]

Alger et al.

[11] 4,455,115

[45] Jun. 19, 1984

[54] HYDRAULIC SHEET STACKING AND WEIGHING SYSTEM

[75] Inventors: Richard N. Alger, Moulton, Ga.; John A. Hall, Lexington, Ala.

[73] Assignee: Champion International Corporation, Stamford, Conn.

[21] Appl. No.: 401,876

[22] Filed: Jul. 26, 1982

[51] Int. Cl.[3] ..... B65H 31/08

[52] U.S. Cl. ..... 414/21; 73/862.54; 177/147; 187/20; 271/217; 414/98

[58] Field of Search ..... 414/21, 98, 99, 100, 414/118, 119; 271/147, 152–159, 217, 218, 219; 83/77; 177/146, 147; 73/862.54, 862.56; 187/1 R, 1 A, 20, 22, 94, 8.59; 212/158

[56] References Cited

U.S. PATENT DOCUMENTS

| | | | |
|---|---|---|---|
| 3,028,980 | 4/1962 | Lindquist | 414/21 X |
| 3,104,141 | 9/1963 | Roulina | 187/22 X |
| 3,477,712 | 11/1969 | Stotzer et al. | 271/218 X |
| 3,583,614 | 6/1971 | Foster | 414/100 X |
| 3,605,837 | 9/1971 | Lambert et al. | 83/77 X |
| 3,905,595 | 9/1975 | Adams et al. | 414/100 |
| 4,058,178 | 11/1977 | Shinohara et al. | 177/146 |
| 4,137,977 | 2/1979 | Alger | 177/146 |

FOREIGN PATENT DOCUMENTS

| | | | |
|---|---|---|---|
| 142746 | 1/1951 | Australia | 414/98 |
| 2749912 | 3/1979 | Fed. Rep. of Germany | 271/217 |

*Primary Examiner*—Leslie J. Paperner

*Attorney, Agent, or Firm*—Evelyn M. Sommer; William W. Jones

[57] ABSTRACT

A mechanism for stacking and weighing sheets fed from a semi-continuous sheet cutter. The mechanism includes a hydraulic cylinder operatively connected to a stacking table so that as sheets are deposited onto the stacking table, the table is lowered by indexing the hydraulic cylinder. This continues until a full stack of sheets, having a predetermined number of sheets determined by weight, by height of the stack or by sheet count has been stacked on the table. The hydraulic cylinder comprises a hydraulic fluid reservoir, an electrically driven hydraulic pump, a four-way, three position hydraulic spool valve, a hydraulic cylinder and back pressure safety valve. A load cell connected between the hydraulic cylinder and the rest of the mechanism is connected to a scale device which will weigh the stack of sheets.

6 Claims, 5 Drawing Figures

HYDRAULIC SHEET STACKING AND WEIGHING SYSTEM

BACKGROUND OF THE INVENTION

The present invention relates to sheet stacking and weighing devices and more particularly to an automatic hydraulic stacking and weighing system. Sheets of paper, pulp, plywood, etc. are conveyed from a sheet cutter by a conveyor and are stacked one on top of the other on a stacking table. The stacking table is indexed downwardly as sheets are assembled thereon until a full stack of sheets has accumulated - determined either by stack weight, stack height or sheet count.

Different types of systems are and have been used to perform this stacking and weighing operation. Some of these systems are completely mechanical in nature while others employ hydraulic systems, a plurality of hydraulic cylinders or electro-mechanical mechanisms. These known systems have a number of drawbacks. Completely mechanical systems are cumbersome and require constant maintenance due to the large number of moving parts such systems require. Hydraulic systems employing a plurality of hydraulic cylinders also require maintenance and are hard to control since one cylinder may tend to index more than the others. Electro-mechanical systems also require high maintenance since an electric motor must be started and stopped many times in indexing to a full load of sheets.

SUMMARY OF THE INVENTION

The present invention overcomes these drawbacks and has for one of its objects the provision of an improved hydraulic sheet stacking and weighing system capable of stacking sheets and weighing the stack in a single operation.

Another object of the present invention is the provision of an improved stacking and weighing system in which the stack weight may be both self-checking and self-calibrating.

Another object of the present invention is the provision of an improved stacking and weighing system which uses only a few moving parts.

Another object of the present invention is the provision of an improved stacking and weighing system which uses a single valve for indexing the stacking table up, down or leaving it in a neutral weighing position.

Another object of the present invention is the provision of an improved stacking and weighing system in which the stacking table is moved upwardly and downwardly uniformly so as to maintain a predetermined level.

Other and further objects of the invention will be obvious upon an understanding of the illustrative embodiment about to be described, or will be indicated in the appended claims, and various advantages not referred to herein will occur to one skilled in the art upon employment of the invention in practice.

In accordance with the present invention, the hydraulic system includes a single hydraulic cylinder which supports the stacking table holding the stack of sheets and indexes continuously as the stack of sheets grows larger. The weight of the stack of sheets is continuously monitored as sheets are fed onto the top of the stack. At some predetermined weight, the process is stopped for removal of the stack of sheets or a system for temporarily holding a new stack of sheets until the full stack is lowered onto a conveying equipment and removed from the stacking table. The stacking table is then raised to start accumulating a new stack of sheets; thereby making the stacking process continuous. The stacking table may be indexed manually or by other methods such as sheet count, stack weight or stack height.

DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
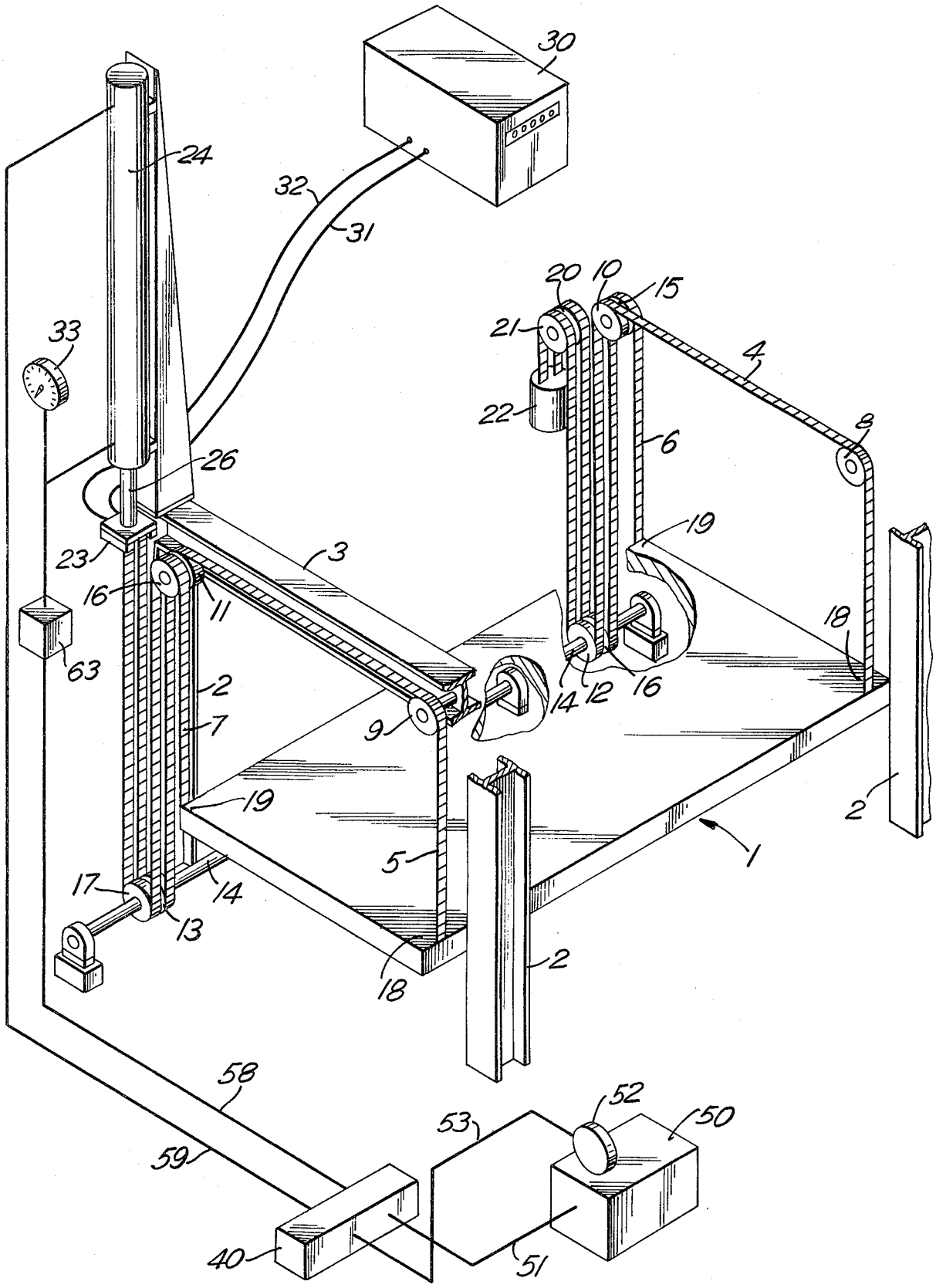
FIG. 1 is a perspective view of a hydraulic stacking and weighing mechanism made in accordance with the present invention.

Referring to the drawings, and more particularly to FIG. 1, the hydraulic sheet stacking and weighing system of the present invention comprises a stacking table 1 adapted to move upwardly and downwardly along a plurality of bearing standards 2 mounted on frame 3 which are preferably located adjacent the corners 18 and 19 of the stacking table 1. The stacking table 1 may be provided with runners or rollers (not shown) which extend within the standards 2 to allow the stacking table 1 to move upwardly and downwardly therealong.

Chains 4, 5, 6 and 7 are attached to the corners 18 of the stacking table 1 in any conventional manner. The chains 4–7 are adapted to be moved uniformly so that the stacking table 1 will be raised or lowered without tilting. The chains 4 and 5 extend from a pair of corners 18 of table 1 and are adapted to move vertically upwardly over sprockets 8 and 9, respectively, positioned above the said pair of corners 18 of the lifting table 1. The chains 4–5 then move horizontally over sprockets 10 and 11, respectively, above the other pair of corners 19 of the lifting table 1 and vertically downwardly under sprockets 12 and 13, respectively, which are attached to a common shaft 14 which may be located beneath the stacking table 1. The chains 6 and 7 extend from the other pair of corners 19 of stacking table 1 and are moved vertically upwardly over sprockets 15 and 16, respectively, which are on the same shaft as sprockets 10 and 11. The chains 6-7 are then moved vertically downwardly under sprockets 25-17, respectively, also on shaft 14. The sprockets 8–9; 10–11 and 15–16 are on the same horizontal plane and the sprockets 12–13 and 17–25 are not only on the same horizontal plane but are also on the same horizontal shaft 14.

The chains 4 and 6 are then directed vertically upwardly over balancing sprockets 20–21, respectively, to a counter balance weight 22. The chains 5 and 7 are also directed vertically upwardly but are connected to a load cell 23 mounted on the rod 26 of a hydraulic cylinder 24. As will be explained in greater detail hereinafter, the cylinder 24 controls the amount of movement of the chains 4–7 and, therefore, the amount of lifting or lowering of the stacking table 1. The movement of chains 4–7 are controlled by the shaft 14 so that when the shaft 14 is rotated by the extension or retraction of the rod 26, the chains 4–7 and the stacking table 1 will move up or down uniformly. The load cell 23 may be connected to a weighing mechanism 30 which may be an electronic scale connected by means of leads 31–32 which will weight the stack of sheets on the stacking table 1. The counterweight 22 maintains chains 4+6 under constant tension.

Figure 2:
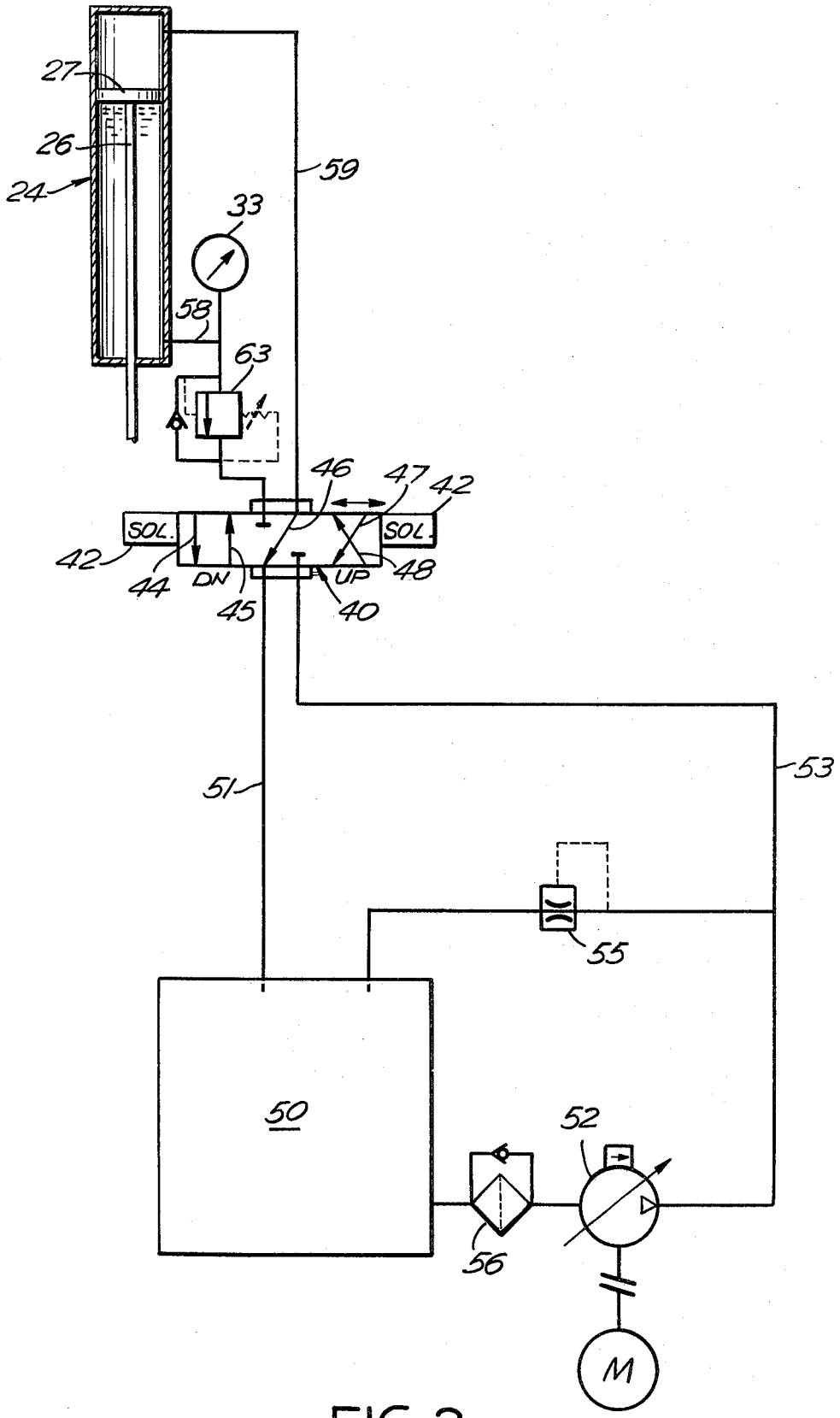
FIG. 2 is a schematic view of the various components of the hydraulic system used in the present invention.

The hydraulic cylinder 24 has a rod 26 and a piston 27 and is hydraulically connected to a source of fluid 50 by means of lines 51–53 and lines 58–59 through the intermediation of a control valve 40. As shown in FIG. 2, the control valve 40 is a three position spring-centered valve which is movable by means of the usual solenoids 42. The control valve 40 has a plurality of internal passageways 44–45, 46 and 47–48. Depending on the position of the control valve 40, passageways 44–48 are placed into a plurality of alignments with lines 58–59 and 51–53 to connect the reservoir 50 and pump 52 with the rod side or the piston side of the cylinder 24 to permit the stacking table 1 to be moved either up or down or remain in a neutral position.

A motor mechanism M controls the pump 52 which supplies fluid under pressure to the control valve 40 through lines 53. Hydraulic fluid is stored in reservoir 50 which flows through filter 56 to pump 52 where hydraulic pressure is developed. A safety valve 63 is provided in the line 58 to prevent the stacking table 1 from falling abruptly. A pressure gauge 33 may also be provided to give a visual reading to the operator. Also provided for the lines 53 is a bleed-off valve 55 to remove any air bubbles therefrom. The pump 52 is of the variable displacement-pressure compensating type which prevents the pump from dead heading when control valve 40 is in the neutral-weighing position.

Figure 3:
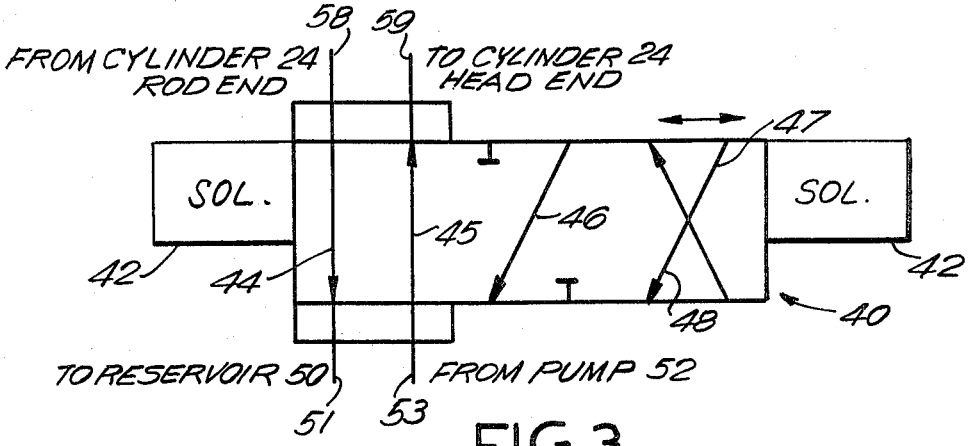
FIG. 3 is a schematic view of the four-way three position valve used in the present invention and shown in an index down or lowered position.
Figure 4:
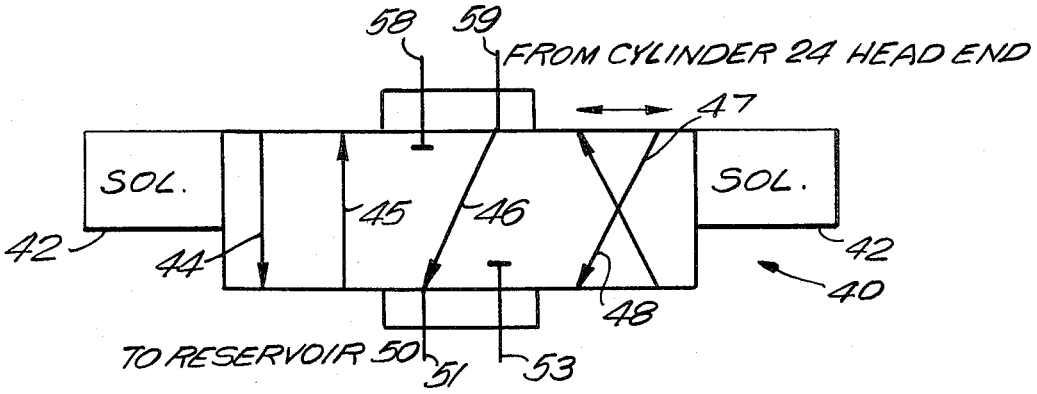
FIG. 4 is a schemtic view of the valve shown in the neutral and weighing position.
Figure 5:
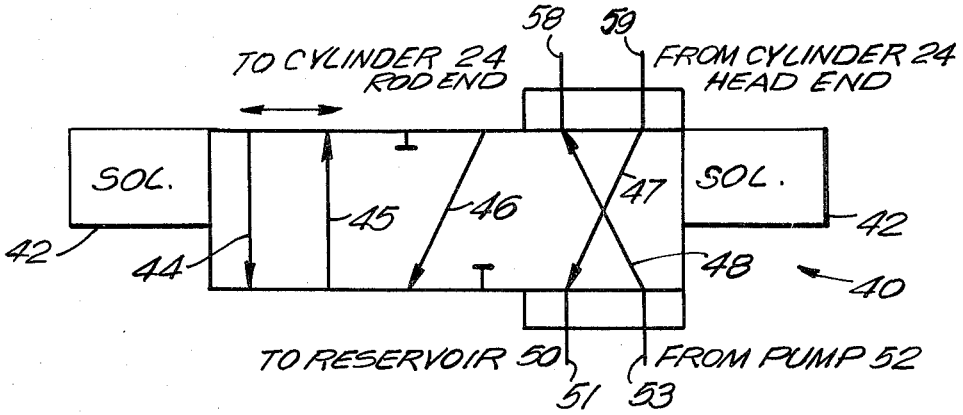
FIG. 5 is a schematic view of the valve shown in the index up or raised position.

When the control valve 40 is in the up indexing position of FIG. 5, the stacking table 1 is adapted to be moved upwardly in order for sheets to be added to the stacking table 1 to start a stack. When the control valve 40 is in the down indexing position of FIG. 3, the stacking table is adapted to move downwardly for removal of the stack. When the control valve is in the neutral position of FIG. 4, the stacking table 1 is in position to be weighed with the stack thereon.

As set forth above, the control valve 40 is preferably of the solenoid operated spring return type having a plurality of paths 44–48 therewithin. In the down position of FIG. 3, the rod side of the cylinder 24 is connected to the reservoir 50 by through line 58, pressure valve 63, path 44 and line 51 and the piston side of the control cylinder 24 is connected to the pump 52 through line 59, path 45 and line 53. Thus, when the valve 24 is moved into this position, fluid is directed to the piston side of the cylinder 24 and is withdrawn from the rod side thereof. When the pressure of pressure valve 63 is overcome, the piston 27 and its rod 26 are moved downwardly. This moves chains 5 and 7 downwardly thereby rotating shaft 14 to move chains 4 and 6 downwardly so that the stacking table 1 will move downwardly.

When the valve 40 is moved into the up position of FIG. 5, the pump 52 is connected to the rod side of the control cylinder 24 through line 53, path 48 and line 58 and the reservoir is connected to the piston side through line 51, path 47 and line 59 so that the fluid is directed to the rod side to move the piston 27 up and retract the rod 26 within the cylinder 24. This moves chains 5 and 7 upwardly to rotate shaft 14 in the reverse direction and move chains 4 and 6 upwardly to raise the stacking table 1.

When the control valve 40 is moved to the neutral position of FIG. 4, the control valve has a single path 46 which connects the piston side of the cylinder 24 with the reservoir 50 but disconnects the pump 52 from the cylinder 24. In this position, the stacking table 1 is in the neutral-weighing position.

When it is desired to start stacking sheets on the stacking table 1, the table 1 is moved upwardly to receive the sheets by moving the control valve 40 to the up indexing position of FIG. 5. When the stacking table 1 is in this upward position, the control valve 40 is moved to the neutral central position of FIG. 4. The load cell 23 attached to the rod 26 and connected to a weighing device 30 is activated so that the weight of the stack may be continuously monitored. Alternately, a counting device (not shown) may be used to count the number of sheets being stacked on the stacking table. As another alternative, a height gauge (not shown) may be used to monitor the height of the stack.

When the stack has reached a predetermined dimension as determined by weight, the number of sheets, or height of the stack, the stack is then ready to be removed. In order to do this, the operator moves the control valve 40 to the down position of FIG. 3 so that the stacking table 1 moves to a lowered position to permit the stack to be removed. The stacking table is then raised again and the operation is repeated.

The operation of the system will be summarized by referring to the drawings, and more particularly to FIG. 1. Sheets (not shown) which have been cut to size by a suitable mechanism (not shown) are delivered by any conventional means (not shown) onto the stacking table 1. As the stack of sheets builds up, control valve 40 is switched to the index down position (FIG. 3) until stacking table 1 is in the desired position. High pressure hydraulic fluid from pump 52 is applied to the four-way three position spring centered control solenoid valve 40. When control valve 40 is moved to a position to lower the table, high pressure hydraulic fluid is applied to the piston end of cylinder 24. When enough pressure has been built to overcome the setting of counter balance valve 63, the table will move down and continue to move down until valve 40 is switched to the neutral-weigh position (FIG. 4). Pressure will then be relieved from cylinder 24 and hydraulic fluid can then flow back to reservoir 50. This process is repeated as many times as is necessary to obtain a full stack of sheets whether measured by weight, sheet count or by stack height.

When valve 40 is switched to the raise position (FIG. 5), high pressure hydraulic fluid from pump 52 is directed to the rod end of cylinder 24 through counter balance valve 63. Hydraulic fluid from the piston end of cylinder 24 then flows back to reservoir 50. The rod of cylinder 24 will continue to retract until it reaches the end of its stroke or valve 40 is switched back to the position shown in FIG. 2.

When a full stack of sheets is obtained, control valve 40 is then switched to the lower or down position (FIG. 3) until table 1 is in a desired position to unload the full stack either by an automatic conveyor or some other means (not shown). When table 1 has been unloaded, valve 40 is then switched to the index up or raised position (FIG. 5) until stacking table 1 is in the proper position to receive the first sheet of a new stack. Valve 40 is then switched to the neutral-weigh position and the entire process is then repeated.

It should be noted that if it is desired for the sheets to continue to flow during the unloading of a full stack, some means (not shown) may be provided to stack the sheets temporarily until the unloading process is complete and table 1 is raised to a position to accept sheets.

The size of cylinder 24 and pump 52 are selected for the weight of the load and speed of operation. Counter balance valve 63 is set initially to a pressure which will not allow table 1 to fall by gravity should the hydraulic system fail. When the size of the cylinder is known, pressure gauge 33 may be calibrated to read weight. Sprockets and all chains and cross shaft 14 as well as table 1 will raise and lower evenly on all four corners.

The system described above has self-checking or self-calibrating capabilities. Since the downward force of sheets on the stacking table 1 exerts an equal force on the rod 26 of the hydraulic cylinder 24 and since the oil pressure in the rod end of the hydraulic cylinder 24 can be easily monitored, the stack weight may be calculated as the hydraulic pressure multiplied by the area of the piston minus the area of the rod which will equal the total weight of the stack and the table.

It will thus be seen that the present invention provides an improved hydraulic sheet stacking and weighing system which is capable of stacking sheets and weighing the stack in a single operation, which may be both self-checking and self-calibrating, which uses only a few moving parts and a single valve for indexing the stacking table up, down or leaving it in a neutral weighing position.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. An apparatus for receiving a stack of sheets of material, said apparatus comprising:

(a) a table for receiving and supporting sheets fed serially thereto to form a stack of the sheets on said table;

(b) guide means for guiding said table in vertical reciprocal movement;

(c) a first pair of chains secured to said table on a first side thereof, one of said first pair of chains being journaled on first and second sprockets disposed above said first side of said table, and the other of said first pair of chains being journaled on a third sprocket disposed above said first side of said table;

(d) a drive shaft disposed below said table;

(e) a first pair of drive sprockets mounted on said drive shaft with said first pair of chains being journaled on said first pair of drive sprockets;

(f) a second pair of chains secured to said table on a second side thereof, one of said second pair of chains being journaled on fourth and fifth sprockets disposed above said second side of said table, and the other of said second pair of chains being journaled on a sixth sprocket disposed above said second side of said table;

(g) a second pair of drive sprockets mounted on said drive shaft with said second pair of chains being journaled on said second pair of drive sprockets;

(h) a cylinder mounted above said table, said cylinder containing a piston reciprocally mounted therein and said piston having a rod portion protruding from said cylinder;

(i) said second pair of chains being secured to said rod portion of said piston; and (j) means for supplying fluid to said cylinder to cause selected reciprocal movement of said piston in said cylinder with movement of said piston in a retracting direction being operable through said second pair of chains to rotate said drive shaft in a first direction whereupon said table is lifted, and movement of said piston in a protracting direction being operable through said second pair of chains to allow rotation of said drive shaft in the opposite direction whereupon said table is lowered.

2. The apparatus of claim 1 wherein said means for supplying fluid comprises a control valve selectively operable in a first position to cause the fluid to move said piston in said retracting direction; and selectively operable in a second position to cause the fluid to move said piston in said protracting direction; and selectively operable in a third position to cause the fluid to hold said piston in a fixed position.

3. The apparatus of claim 1 wherein said means for supplying fluid comprises a counter balance valve operable to hold said table in a fixed position in the event of failure of said means for supplying fluid to operate properly.

4. The apparatus of claim 1 further comprising a load cell interposed between said second pair of chains and said piston rod; and an electronic scale operably connected to said load cell for continuously weighing the stack of sheets on said table.

5. The apparatus of claim 4 further comprising a pressure gauge operably connected to said cylinder and calibrated to convert fluid pressure sensed in said cylinder to units of weight whereby operation of said electronic scale is continuously monitored.

6. The apparatus of claim 1 further compirsing a pressure gauge operably connected to said cylinder and calibrated to convert fluid pressure sensed in said cylinder to units of weight whereby the weight of the sheet stack is continuously monitored.

* * * * *